US006611996B2

(12) United States Patent
Blythe et al.

(10) Patent No.: US 6,611,996 B2
(45) Date of Patent: Sep. 2, 2003

(54) SLIDER FOR RECLOSABLE FASTENER

(75) Inventors: James S. Blythe, Rochester, NY (US); Eric A. St. Phillips, Fairport, NY (US)

(73) Assignee: Pactiv Corporation, Lake Forest, IL (US)

( * ) Notice: Subject to any disclaimer, the term of this patent is extended or adjusted under 35 U.S.C. 154(b) by 79 days.

(21) Appl. No.: 09/897,312

(22) Filed: Jul. 2, 2001

(65) Prior Publication Data

US 2003/0000050 A1 Jan. 2, 2003

(51) Int. Cl.[7] ..... A44B 19/16; B65D 33/00

(52) U.S. Cl. ..... 24/399; 24/400; 24/415; 24/585.1; 24/585.12

(58) Field of Search ..... 24/399, 400, 415, 24/585.1, 585.12, 572.1; 383/5, 63, 65

(56) References Cited

U.S. PATENT DOCUMENTS

| | | | |
|---|---|---|---|
| 1,785,234 | A | 12/1930 | Sundback |
| 2,091,617 | A | 8/1937 | Sundback |
| 2,440,012 | A | 4/1948 | Haver ..... 24/30.5 |
| 2,779,385 | A | 1/1957 | Carlzen et al. |
| 2,978,769 | A | 4/1961 | Harrah |
| 3,104,798 | A | 9/1963 | Stone |
| 3,149,927 | A | 9/1964 | Fady |
| 3,172,443 | A | 3/1965 | Ausnit |
| 3,181,583 | A | 5/1965 | Lingenfelter |
| 3,198,228 | A | 8/1965 | Naito |
| 3,225,429 | A | 12/1965 | Fady |
| 3,259,951 | A | 7/1966 | Zimmerman |
| 3,282,493 | A | 11/1966 | Kamins et al. |
| 3,313,471 | A | 4/1967 | Dickard et al. |
| 3,325,084 | A | 6/1967 | Ausnit |
| 3,326,399 | A | 6/1967 | Ausnit |
| 3,381,592 | A | 5/1968 | Ravel |
| 3,394,798 | A | 7/1968 | Sako |
| 3,426,396 | A | 2/1969 | LaGuerre |
| 3,462,068 | A | 8/1969 | Suominen |
| 3,471,005 | A | 10/1969 | Sexstone |
| 3,473,589 | A | 10/1969 | Gotz |
| 3,532,571 | A | 10/1970 | Ausnit |
| RE27,174 | E | 9/1971 | Ausnit |
| 3,608,439 | A | 9/1971 | Ausnit |
| 3,613,524 | A | 10/1971 | Behr |
| 3,633,642 | A | 1/1972 | Siegel |
| 3,644,981 | A | 2/1972 | Gustavsson |
| 3,701,191 | A | 10/1972 | Laguerre |

(List continued on next page.)

FOREIGN PATENT DOCUMENTS

| | | |
|---|---|---|
| EP | 0 016 601 A1 | 10/1980 |
| EP | 0 239 319 B1 | 3/1987 |
| EP | 0 371 402 A1 | 6/1990 |
| EP | 0 371 402 A3 | 6/1990 |
| EP | 0 371 402 B1 | 6/1990 |
| GB | 522663 | 6/1940 |
| GB | 2 085 519 | 10/1980 |
| GB | 2 138 494 | 3/1983 |
| WO | WO 91/13759 | 9/1991 |
| WO | WO 95/29604 | 11/1995 |
| WO | WO 95/35046 | 12/1995 |
| WO | WO95/35047 | 12/1995 |
| WO | WO 95/35048 | 12/1995 |
| WO | 99/24325 | 5/1999 |

*Primary Examiner*—Victor Sakran
(74) *Attorney, Agent, or Firm*—Jenkens & Gilchrist

(57) ABSTRACT

A slider for a reclosable fastener for plastic bags comprises a body. The body includes a top, a first side, a second side and a separation member on an underside of the top. The separation member is adapted to open and close the fastener. The first side has at least one slot for separating the first side into at least two sections. The second side has at least one slot for separating the second side into at least two sections. Each of the slots extends from respective ends of the first and second sides opposite the top and extends through the respective first and second sides.

29 Claims, 5 Drawing Sheets

U.S. PATENT DOCUMENTS

| | | | | |
|---|---|---|---|---|
| 3,701,192 | A | 10/1972 | Laguerre | |
| 3,746,215 | A | 7/1973 | Ausnit et al. | |
| 3,780,781 | A | 12/1973 | Uramoto | |
| 3,785,111 | A | 1/1974 | Pike | |
| 3,839,128 | A | 10/1974 | Arai | |
| 3,849,843 | A | 11/1974 | Alberts | |
| 3,868,891 | A | 3/1975 | Parish | |
| 3,948,705 | A | 4/1976 | Ausnit | |
| 3,962,007 | A | 6/1976 | Helmberger | |
| 3,970,992 | A | 7/1976 | Boothroyd et al. | |
| 3,991,801 | A | 11/1976 | Ausnit | |
| 4,094,729 | A | 6/1978 | Boccia | |
| 4,101,355 | A | 7/1978 | Ausnit | |
| 4,122,594 | A | 10/1978 | Azzara | |
| 4,173,283 | A | 11/1979 | Taamatsu | |
| 4,191,230 | A | 3/1980 | Ausnit | |
| 4,196,030 | A | 4/1980 | Ausnit | |
| 4,232,429 | A | 11/1980 | Friedberg | |
| 4,235,653 | A | 11/1980 | Ausnit | |
| 4,240,241 | A | 12/1980 | Sanborn, Jr. | |
| 4,241,865 | A | 12/1980 | Ferrell | |
| 4,249,982 | A | 2/1981 | Ausnit | |
| 4,262,395 | A | 4/1981 | Kosky | 24/201 |
| 4,277,241 | A | 7/1981 | Schulza | |
| 4,285,376 | A | 8/1981 | Ausnit | |
| 4,341,575 | A | 7/1982 | Herz | |
| 4,355,494 | A | 10/1982 | Tilman | |
| 4,372,793 | A | 2/1983 | Herz | |
| 4,392,897 | A | 7/1983 | Herrington | |
| 4,410,130 | A | 10/1983 | Herrington | |
| 4,415,386 | A | 11/1983 | Ferrell et al. | |
| 4,419,159 | A | 12/1983 | Herrington | |
| RE31,487 | E | 1/1984 | Friedberg | |
| 4,430,070 | A | 2/1984 | Ausnit | |
| 4,437,293 | A | 3/1984 | Sanborn, Jr. | |
| 4,443,400 | A | 4/1984 | Herrington | |
| 4,517,788 | A | 5/1985 | Scheffers | |
| 4,518,087 | A | 5/1985 | Goglio | |
| 4,519,095 | A | 5/1985 | Clayton | |
| 4,528,224 | A | 7/1985 | Ausnit | |
| 4,532,652 | A | 7/1985 | Herrington | |
| 4,561,109 | A | 12/1985 | Herrington | |
| 4,563,319 | A | 1/1986 | Ausnit et al. | |
| 4,581,006 | A | 4/1986 | Hugues et al. | |
| 4,582,549 | A | 4/1986 | Ferrell | |
| 4,601,694 | A | 7/1986 | Ausnit | |
| 4,603,434 | A | 7/1986 | Herrington | |
| 4,612,153 | A | 9/1986 | Mangla | |
| 4,617,683 | A | 10/1986 | Christoff | |
| 4,618,383 | A | 10/1986 | Herrington | |
| 4,620,320 | A | 10/1986 | Sullivan | |
| 4,651,504 | A | 3/1987 | Bentsen | |
| 4,655,862 | A | 4/1987 | Christoff et al. | |
| 4,663,915 | A | 5/1987 | Van Erden et al. | |
| 4,666,536 | A | 5/1987 | Van Erden et al. | |
| 4,673,383 | A | 6/1987 | Bentsen | |
| 4,691,372 | A | 9/1987 | Van Erden | |
| 4,703,518 | A | 10/1987 | Ausnit | |
| 4,709,398 | A | 11/1987 | Ausnit | |
| 4,709,533 | A | 12/1987 | Ausnit | |
| 4,710,157 | A | 12/1987 | Posey | |
| 4,713,839 | A | 12/1987 | Peppiatt | |
| 4,736,450 | A | 4/1988 | Van Erden et al. | |
| 4,744,674 | A | 5/1988 | Nocek | |
| 4,782,951 | A | 11/1988 | Griesbach et al. | |
| 4,786,190 | A | 11/1988 | Van Erden et al. | |
| 4,787,754 | A | 11/1988 | Herrington | |
| 4,787,880 | A | 11/1988 | Ausnit | |
| 4,790,126 | A | 12/1988 | Boeckmann | |
| 4,791,710 | A | 12/1988 | Nocek et al. | |
| 4,792,240 | A | 12/1988 | Ausnit | |
| 4,807,300 | A | 2/1989 | Ausnit et al. | |
| 4,812,074 | A | 3/1989 | Ausnit et al. | |
| 4,832,505 | A | 5/1989 | Ausnit et al. | |
| 4,840,012 | A | 6/1989 | Boeckmann | |
| 4,840,611 | A | 6/1989 | Van Erden et al. | |
| 4,844,759 | A | 7/1989 | Boeckmann | |
| 4,846,585 | A | 7/1989 | Boeckmann et al. | |
| 4,850,178 | A | 7/1989 | Ausnit | |
| 4,863,285 | A | 9/1989 | Claxton | |
| 4,876,842 | A | 10/1989 | Ausnit | |
| 4,877,336 | A | 10/1989 | Peppiatt | |
| 4,878,987 | A | 11/1989 | Ven Erden | |
| 4,891,867 | A | 1/1990 | Takeshima et al. | |
| 4,892,414 | A | 1/1990 | Ausnit | |
| 4,892,512 | A | 1/1990 | Branson | |
| 4,894,975 | A | 1/1990 | Ausnit | |
| 4,909,017 | A | 3/1990 | McMahon et al. | |
| 4,923,309 | A | 5/1990 | VanErden | |
| 4,925,316 | A | 5/1990 | Van Erden et al. | |
| 4,925,318 | A | 5/1990 | Sorensen | |
| 4,929,225 | A | 5/1990 | Ausnit et al. | |
| 4,941,307 | A | 7/1990 | Wojcik | |
| 4,969,309 | A | 11/1990 | Schwarz et al. | |
| 4,971,454 | A | 11/1990 | Branson et al. | |
| 4,974,395 | A | 12/1990 | McMahon | |
| 4,987,658 | A | 1/1991 | Horita | |
| 4,993,212 | A | 2/1991 | Veoukas | |
| 5,004,356 | A | 4/1991 | Matsui | |
| 5,007,142 | A | 4/1991 | Herrington | |
| 5,007,143 | A | 4/1991 | Herrington | |
| 5,007,146 | A | 4/1991 | Meidan | 24/683 |
| 5,010,627 | A | 4/1991 | Herrington et al. | |
| 5,014,498 | A | 5/1991 | McMahon | |
| 5,017,021 | A | 5/1991 | Simonsen et al. | |
| 5,020,194 | A | 6/1991 | Herrington et al. | |
| 5,023,122 | A | 6/1991 | Boeckmann et al. | |
| 5,024,537 | A | 6/1991 | Tilman | |
| 5,027,584 | A | 7/1991 | McMahon et al. | |
| RE33,674 | E | 8/1991 | Uramoto | |
| 5,036,643 | A | 8/1991 | Bodolay | |
| 5,042,224 | A | 8/1991 | McMahon | |
| 5,046,300 | A | 9/1991 | Custer et al. | |
| 5,050,736 | A | 9/1991 | Griesbach et al. | |
| 5,063,069 | A | 11/1991 | Van Erden et al. | |
| 5,063,639 | A | 11/1991 | Boeckmann et al. | |
| 5,063,644 | A | 11/1991 | Herrington et al. | |
| 5,067,208 | A | 11/1991 | Herrington, Jr. et al. | |
| 5,067,822 | A | 11/1991 | Wirth et al. | |
| 5,070,583 | A | 12/1991 | Herrington | |
| 5,071,689 | A | 12/1991 | Tilman | |
| 5,072,571 | A | 12/1991 | Boeckmann | |
| 5,085,031 | A | 2/1992 | McDonald | |
| 5,088,971 | A | 2/1992 | Herrington | |
| 5,092,684 | A | 3/1992 | Weeks | |
| 5,092,831 | A | 3/1992 | James et al. | |
| 5,096,516 | A | 3/1992 | McDonald et al. | |
| 5,100,246 | A | 3/1992 | LaPierre et al. | |
| 5,107,658 | A | 4/1992 | Hustad et al. | |
| 5,111,643 | A | 5/1992 | Hobock | |
| 5,112,138 | A | 5/1992 | Peppiatt | |
| 5,116,301 | A | 5/1992 | Robinson et al. | |
| 5,121,997 | A | 6/1992 | La Pierre et al. | |
| 5,127,208 | A | 7/1992 | Custer et al. | |
| 5,129,734 | A | 7/1992 | Van Erden | |
| 5,131,121 | A | 7/1992 | Herrington, Jr. et al. | |
| 5,152,613 | A | 10/1992 | Herrington, Jr. | |
| 5,161,286 | A | 11/1992 | Herrington, Jr. et al. | |
| 5,167,608 | A | 12/1992 | Steffens, Jr. et al. | |
| 5,179,816 | A | 1/1993 | Wojnicki | |
| 5,185,909 | A | 2/1993 | Inagaki | |

5,186,543 A 2/1993 Cochran
5,188,461 A 2/1993 Sorensen
5,189,764 A 3/1993 Herrington et al.
5,198,055 A 3/1993 Wirth et al.
5,211,482 A 5/1993 Tilman
5,224,779 A 7/1993 Thompson et al.
5,238,306 A 8/1993 Heintz et al.
5,247,781 A 9/1993 Runge
5,259,904 A 11/1993 Ausnit
5,273,511 A 12/1993 Boeckman
5,279,693 A 1/1994 Robinson et al.
5,283,932 A 2/1994 Richardson et al.
RE34,554 E 3/1994 Ausnit
5,301,394 A 4/1994 Richardson et al.
5,301,395 A 4/1994 Richardson et al.
5,322,579 A 6/1994 Van Erden
5,330,269 A 7/1994 Kamada et al.
5,334,127 A 8/1994 Bruno et al.
5,383,989 A 1/1995 McMahon
5,391,136 A 2/1995 Makowka
5,400,565 A 3/1995 Terminella et al.
5,400,568 A 3/1995 Kanemitsu et al.
RE34,905 E 4/1995 Ausnit
5,403,094 A 4/1995 Tomic
5,405,478 A 4/1995 Richardson et al.
5,405,629 A 4/1995 Marnocha et al.
5,412,924 A 5/1995 Ausnit
5,415,904 A 5/1995 Takubo et al.
5,425,216 A 6/1995 Ausnit
5,425,825 A 6/1995 Rasko et al.
5,426,830 A 6/1995 Richardson et al.
5,431,760 A 7/1995 Donovan
5,435,864 A 7/1995 Machacek et al.
5,442,837 A 8/1995 Morgan
5,442,838 A 8/1995 Richardson et al.
5,448,807 A 9/1995 Herrington, Jr.
5,448,808 A 9/1995 Gross
5,456,928 A 10/1995 Hustad et al.
5,461,845 A 10/1995 Yeager
5,470,156 A 11/1995 May
5,482,375 A 1/1996 Richardson et al.
5,486,051 A 1/1996 May
5,489,252 A 2/1996 May
5,492,411 A 2/1996 May
5,505,037 A 4/1996 Terminella et al.
5,509,735 A 4/1996 May
5,511,884 A 4/1996 Bruno et al.
5,513,915 A 5/1996 May
5,519,982 A 5/1996 Herber et al.
5,523,136 A 6/1996 Fischer et al.
5,525,363 A 6/1996 Herber et al.
5,529,394 A 6/1996 Davoren
5,542,902 A 8/1996 Richison et al.
5,551,127 A 9/1996 May
5,551,208 A 9/1996 Van Erden
5,552,202 A 9/1996 May
5,557,907 A 9/1996 Malin et al.
5,558,613 A 9/1996 Tilman et al.
5,561,966 A 10/1996 English
5,564,259 A 10/1996 Stolmeier
5,573,614 A 11/1996 Tilman et al.
5,582,853 A 12/1996 Marnocha et al.
5,592,802 A 1/1997 Malin et al.
5,613,934 A 3/1997 May
5,628,566 A 5/1997 Schreiter
5,645,905 A 7/1997 Takubo et al.
5,647,671 A 7/1997 May
5,664,296 A 9/1997 May
5,669,715 A 9/1997 Dobreski et al.
5,681,115 A 10/1997 Diederich et al.
5,682,730 A 11/1997 Dobreski
5,711,751 A 1/1998 Harmanoglu
5,713,110 A 2/1998 Covi et al.
5,713,669 A 2/1998 Thomas et al.
5,718,337 A 2/1998 Carr et al.
5,722,128 A * 3/1998 Toney et al. ..... 24/400
5,725,312 A 3/1998 May
5,769,772 A 6/1998 Wiley
5,775,812 A 7/1998 St. Phillips et al.
5,782,733 A 7/1998 Yeager
5,788,378 A 8/1998 Thomas
5,823,933 A 10/1998 Yeager
5,833,791 A 11/1998 Bryniarski et al.
5,851,070 A 12/1998 Dobreski et al.
5,867,875 A 2/1999 Beck et al.
5,871,281 A 2/1999 Stolmeier et al.
5,896,627 A 4/1999 Cappel et al.
5,906,438 A 5/1999 Laudenberg
5,911,508 A 6/1999 Dobreski et al.
5,919,535 A 7/1999 Dobreski et al.
5,924,173 A 7/1999 Dobreski et al.
5,956,924 A 9/1999 Thieman
5,964,532 A 10/1999 St. Phillips et al.
6,010,244 A 1/2000 Dobreski et al.
6,047,450 A * 4/2000 Machacek et al. ..... 24/399
6,178,722 B1 1/2001 McMahon
6,286,189 B1 9/2001 Provan et al.
6,286,999 B1 * 9/2001 Cappel et al. ..... 383/5
6,289,561 B1 9/2001 Provan et al.
6,292,986 B1 9/2001 Provan et al.
6,327,754 B1 12/2001 Belmont et al. ..... 24/400
6,402,375 B1 * 6/2002 Schreiter et al. ..... 24/399

* cited by examiner

SLIDER FOR RECLOSABLE FASTENER

FIELD OF THE INVENTION

The present invention relates generally to sliders for reclosable fasteners, and, more particularly, sliders that assist in opening and closing polymeric bags.

BACKGROUND OF THE INVENTION

Polymeric bags are popular household items that are used in a variety of applications including storage of food. The addition of reclosable fasteners or zippers to these bags has further enhanced their utility and the addition of a slider has made the fasteners easier to open and close. The fasteners include complementary first and second profiles that engage each other to close the bag.

One problem encountered in installing the slider to the fastener is distortion to the first and second profiles of the fastener. The profiles may be distorted when the slider is placed onto the fastener. More specifically, the profiles may be distorted from internal shoulders of the slider that partially form a cavity of the slider. To assist in preventing distortion to the profiles when inserting the slider onto the fastener, the slider may be constructed to have improved flexibility. These flexible sliders, however, do not generally have a desirable stiffness to remain on the fastener during normal use by a consumer.

To address this problem, some sliders have been developed to be assembled or closed around the first and second profiles of the fastener. These sliders are assembled over the profiles by the use of interlocking structures molded into various portions of the slider. It has also been suggested to incorporate additional part(s) to provide stiffness to the slider. Another solution that has been applied is to fold the slider over the fastener, such as in U.S. Pat. No. 5,067,208. Other solutions have been to cut the profile and insert the slider over a cut end, such as in U.S. Pat. No. 5,431,760. These solutions, however, include additional steps that result in a more complicated and typically lesser efficient manufacturing process.

A need therefore exists for an improved slider that can be inserted over the profiles of the fastener with little or no distortion, while providing a desirable stiffness to remain on the fastener during normal use.

SUMMARY OF THE INVENTION

According to one embodiment, a slider for a reclosable fastener for plastic bags comprises a body. The body includes a top, a first side, a second side and a separation member on an underside of the top. The separation member is adapted to open and close the fastener. The first side has at least one slot for separating the first side into at least two sections. The second side has at least one slot for separating the second side into at least two sections. Each of the slots extends from respective ends of the first and second sides opposite the top and extends through the respective first and second sides.

According to another embodiment, a unitary slider for a reclosable fastener for plastic bags comprises a unitary body. The body includes a top, a first side, a second side and a separation member on an underside of the top. The separation member is adapted to open and close the fastener. The first side has at least two slots for separating the first side into at least three sections. The second side has at least two slots for separating the second side into at least three sections.

Each of the slots extends from respective ends of the first and second sides opposite the top and extends through the respective sides. Each of the slots on the first side corresponds to a respective slot of the second side.

According to yet another embodiment, a slider for a reclosable fastener for plastic bags comprises a body. The body includes a top, a first side, a second side and a separation member on an underside of the top. The separation member is adapted to open and close the fastener. The first side has at least two sections that are partially separated by at least one first weakened portion so as to assist in placing the slider onto the fastener. The second side has at least two sections that are partially separated by at least one second weakened portion so as to assist in placing the slider onto the fastener. The first and second weakened portions extend from respective ends of the first and second sides opposite the top and extend through the respective first and second sides.

According to another embodiment, a fastener and slider arrangement for plastic bags comprises a fastener and a slider. The fastener includes first and second tracks that each have first and second ends, and first and second end terminations at respective first and second ends of the first and second tracks. The first and second tracks include respective first and second interlocking profiles. The slider is mounted on the first and second tracks. The slider includes a top, a first side, a second side and a separation member on an underside of the top. The separation member is adapted to open and close the fastener. The first side has at least one slot for separating the first side into at least two sections. The second side has at least one slot for separating the second side into at least two sections. Each of the slots extends from respective ends of the first and second sides opposite the top and extends through the respective first and second sides.

According to one method of inserting a slider onto a reclosable fastener extending along a mouth of a plastic bag, the fastener includes a first track with a first profile and a second track with a second profile being releasably engageable to the first profile. The slider is slidably mounted to the fastener and includes a top, a first side, a second side and a separation member on an underside of the top. The separation member is adapted to open and close the fastener. The first side has at least one slot for separating the first side into at least two sections. The second side has at least one slot for separating the second side into at least two sections. Each of the slots extends from respective ends of the first and second sides opposite the top and extends through the respective sides. The sides and top have respective inner and outer surfaces. At least a portion of the inner surfaces of the sides forms respective first and second shoulders. The inner surfaces of the first and the second sides and the top define a cavity. A supporting tooling member is placed into at least one slot such that the tooling member is supporting at least one of the first and second profiles. The slider is placed on the fastener by opening one or more of the sections of the slider such that the first and second sides are at a sufficient distance to allow the insertion of the slider onto the first and second profiles. The slider is positioned into the cavity such that the first and second profiles are located above the respective first and second shoulders.

Figure 1:
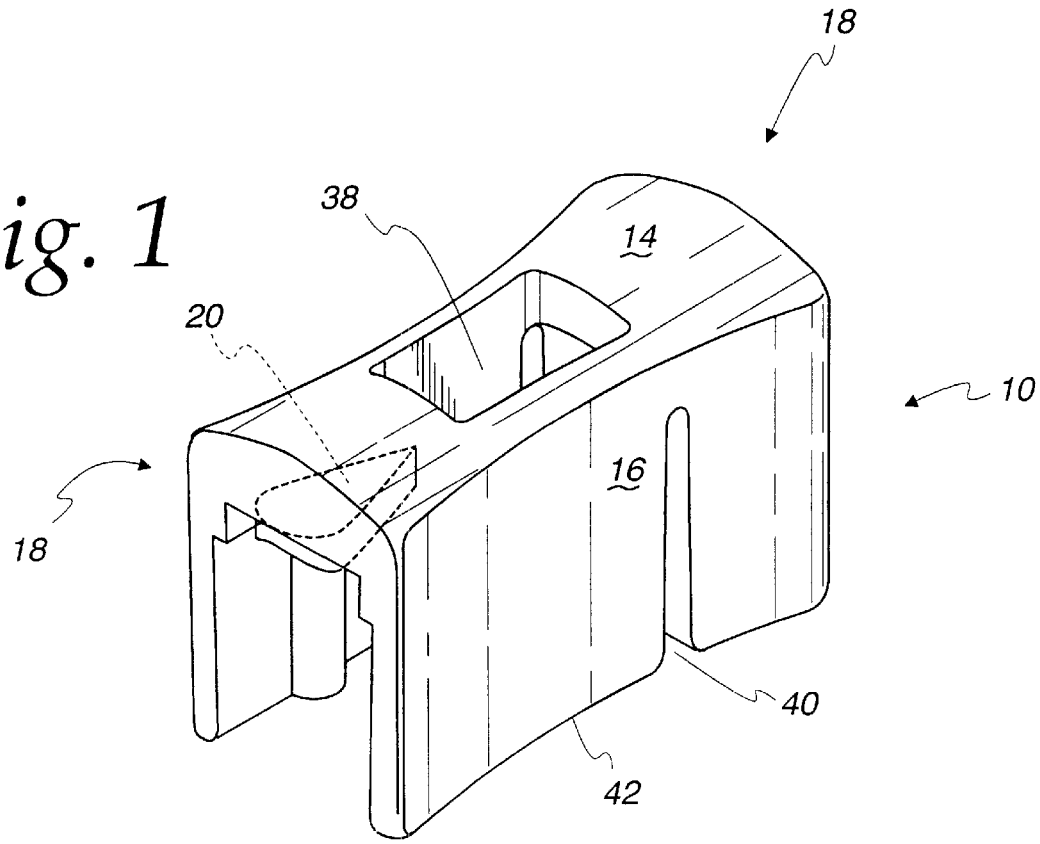
FIG. 1 is an enlarged perspective view of a slider constructed in accordance with one embodiment of the present invention.

While the invention is susceptible to various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DETAILED DESCRIPTION OF THE PREFERRED EMBODIMENTS

Referring initially to FIG. 1, there is illustrated a slider 10 according to one embodiment of the present invention. The slider 10 is a unitary or integral structure and, thus, is a one-piece slider. The slider 10 is an inverted generally U-shaped member. The sliders of the present invention may be combined with a fastener or zipper 12 in forming a thermoplastic bag B (see FIG. 7).

Figure 3:
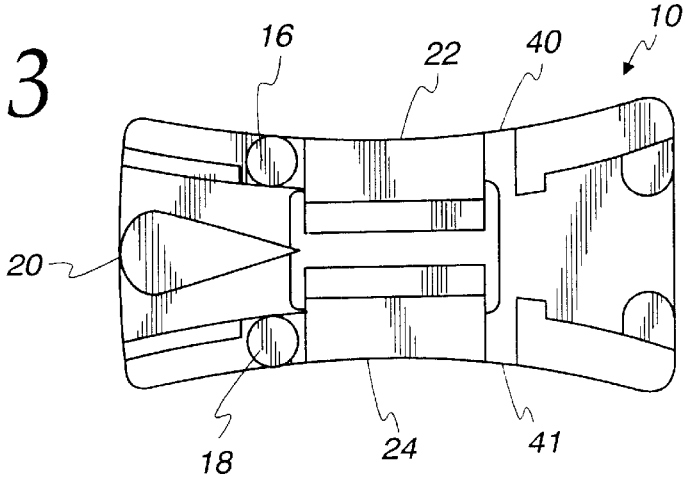
FIG. 3 is a bottom plan view of the slider of FIG. 1.

The slider 10 of FIG. 1 comprises a top 14, a pair of sides or side walls 16 and 18 depending downwardly from the top 14, and a separation member or finger 20 located on an underside of the top 14. The separation finger 20 is positioned between the sides 16 and 18. The bottom plan view of the slider 10 is depicted in FIG. 3.

Figure 5:
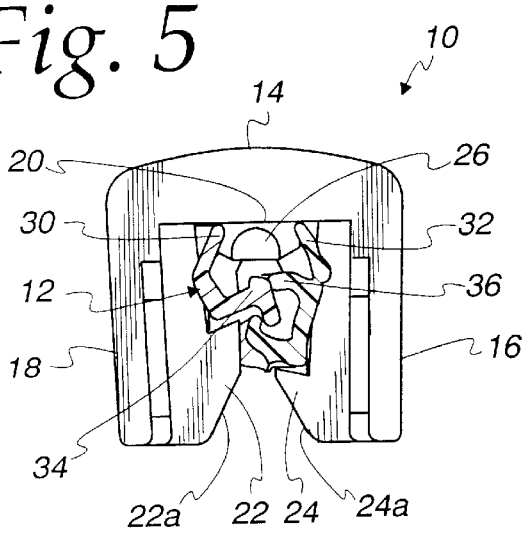
FIG. 5 is an end view of the slider of FIG. 1 and a fastener in the fastener open configuration.

At the lower end of each side 16 and 18 are inwardly extending shoulders 22 and 24 (FIGS. 5 and 6), respectively, which cooperate with the separation finger 20 to assist in opening and closing the fastener 12. The shoulders 22 and 24 also engage the fastener 12 to inhibit or prevent the slider 10 from being lifted off profile edges while the slider 10 straddles the fastener 12. Specifically, the shoulders 22 and 24 engage with lower surfaces of the profiles to inhibit or prevent (a) the slider from being pulled off in a direction perpendicular to the sliding motion and (b) the slider from being removed from the force required to open the profiles. To generate an outward force moment from the downward insertion force to separate the sidewalls and permit a snap-on action, the shoulders 22 and 24 are tapered upwardly towards a center-line of the slider. Tapered surfaces 22*a* and 24*a* assist in guiding the slider onto the fastener 12. The tapered surfaces 22*a* and 24*a* may also be referred to as "leads-ins". The shoulders 22 and 24, however, may be formed without being tapered.

Figure 6:
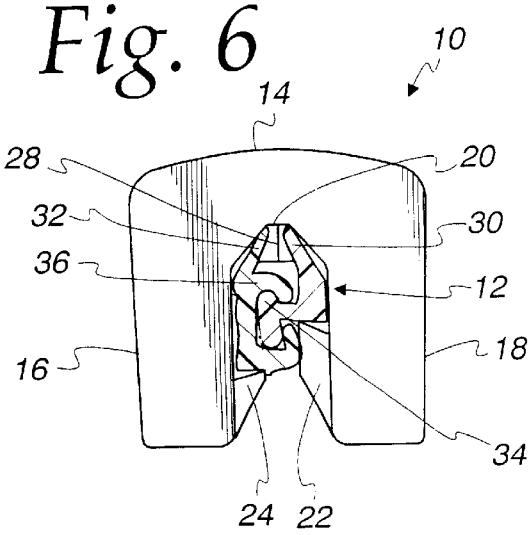
FIG. 6 is an end view of the slider of FIG. 1 and a fastener in the fastener closed configuration.

The separation finger 20 has a wide portion 26 (FIG. 5) and a narrow portion 28 (FIG. 6). The separation finger 20 with the wide and narrow portions 26 and 28 interact with first and second portions 30 and 32 (FIGS. 5 and 6) of the fastener 12 to lock and unlock first and second profiles 34 and 36 on the fastener 12. This interaction opens and closes the fastener 12 in the manner described in U.S. Pat. No. 5,007,143 which is incorporated herein by reference in its entirety.

More specifically, the wide portion 26 of the separation finger 20 in cooperation with the shoulders 22 and 24 spread the first and second portions 30 and 32. The spread first and second portions 30 and 32 separate the first and second profiles 34 and 36 thereby opening the fastener 12 (FIG. 5) as the slider 10 is moved.

To close the fastener 12, the slider 10 is moved in the reverse direction and the narrow portion 28 of the separation finger 20 cooperates with the shoulders 22 and 24 and the sides 16 and 18 of the slider 10 to bring the first and second portions 30 and 32 together. The first and second portions 30 and 32 when brought together lock the first and second profiles 34 and 36 (FIG. 6). To close the fastener 12 completely, at least the wide portion 26 of the separation finger 20 is removed from between the first and second portions 30 and 32 of the fastener 12.

Referring back to FIG. 1, the slider 10 also includes an optional molded window 38 that is formed in the top 14 to assist in forming the shoulders 22 and 24. The optional molded window 38 also assists in holding and/or locating the slider 10 for insertion onto the profiles of the fastener 12.

According to one embodiment, the slider 10 also includes a slot or opening 40 formed in the side 16 (see FIG. 1) and a corresponding slot 41 (see FIG. 3) formed in the side 18. The corresponding slots 40 and 41 assist in (a) placing the slider onto the fastener and (b) optimizing the sections of the slider, including the utilization of the polymeric resins.

The slot 40 of FIG. 1 extends from a bottom edge 42 of the side 16 in a generally vertical direction toward the top 14. The slot 40 is shown in FIG. 1 as extending into and through the side 16. It is contemplated that the slot 40 may be formed in other shapes than that depicted in FIG. 1. If the slider is formed by injection molding, the slot 40 is preferably at least slightly tapered so as to assist in releasing it from the injection mold. Slot 41 is preferably formed in the same manner as described with respect to the slot 40.

Figure 2:
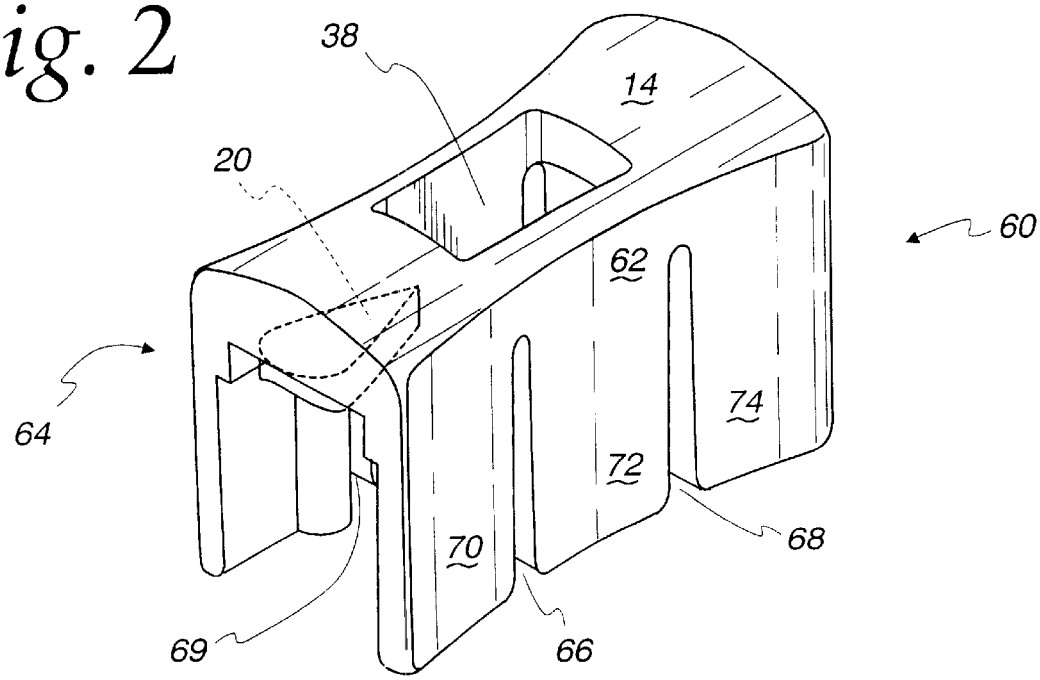
FIG. 2 is an enlarged perspective view of a slider constructed in accordance with another embodiment of the present invention.
Figure 4:
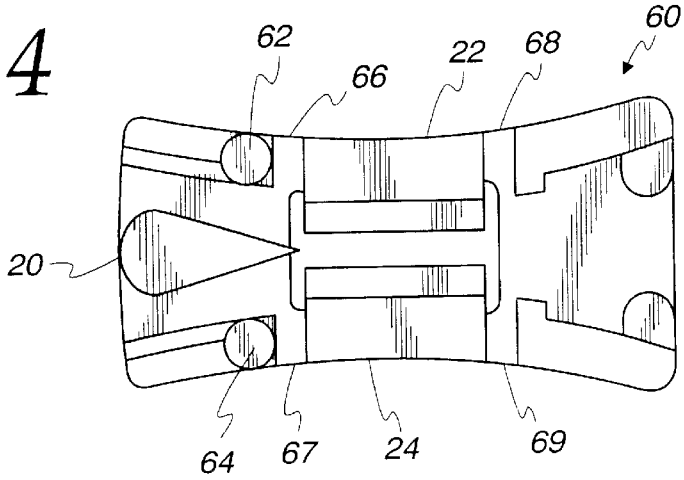
FIG. 4 is a bottom plan view of the slider of FIG. 2.

Referring to FIG. 2, a slider 60 is shown that is identical to the slider 10 of FIG. 1, except that the slider 60 includes two slots that are formed in each side 62 and 64. Side 62 of the slider 60 includes slots 66, 68 formed therein, while the side 64 also has two slots 67 and 69 (shown in FIG. 4) that correspond with respective slots 66 and 68. It is contemplated that additional slots may be formed in the slider 60. The slots of the slider 60 have the same purpose as described above with respect to the slots 40 and 41 of slider 10. In addition, the slots of the slider 60 as will be discussed below may assist in easier insertion of the slider onto the profiles.

The slider 60 of FIG. 2 may be divided into three main functionally independent sections 70, 72 and 74. The main function of section 70 is to assist in opening the fastener, while the main function of the section 74 is to assist in closing the fastener. The main function of the section 72 is to retain the slider 60 on the fastener after installation. The section 72 of slider 60 may have profiled outer surfaces to assist a consumer in grasping and moving the slider. For example, the section 72 of sides 62 and 64 may have outer surfaces that generally correspond to a customer's fingers/thumbs (i.e., concave inwardly) for easier grasping and moving of the slider 60.

The sides 62 and 64 may have varying cross-sectional thicknesses in its respective sections so as to optimize the main function of each section. The sections 70, 72 and 74 also may be profiled to optimally use a desired amount of polymeric resin so as to minimize material usage. For example, the thicknesses of the sides 62 and 64 of section 72 may be optimized for flexibility so as to allow the sides 62 and 64 to bend outwardly when the slider 60 is inserted onto the first and second profiles 34 and 36 of the fastener. (See FIG. 8*b*) The thicknesses of the sides 62 and 64 of sections 70 and 74 are contemplated to be less flexible than section 72.

The locations of sections 70, 72 and 74 may be configured differently than shown in FIG. 2. For example, sections 70, 72 and 74 may be configured such that the section 74 is located between the sections 70 and 72. It is also contemplated that more than one of the same section may be formed in the slider. For example, the slider of FIG. 2 may have a second section 72 located adjacent to section 74 and opposite of the first section 72.

The thicknesses of the sides 62 and 64 of the section 72 are generally from about 15 to about 100 mils. The thicknesses of the sides 62 and 64 of the section 70 are generally from about 15 to about 100 mils. The thicknesses of the sides 62 and 64 of the section 74 are generally from about 15 to about 200 mils.

According to another embodiment, the slider may have corresponding very thin, weakened side sections (less than 10 mils) instead of corresponding slots 40 and 41. The weakened side sections may be perforations. These weakened side sections (not shown) of the slider are configured to break or stretch when the slider is inserted onto the profiles of the fastener. These weakened side sections may be similar in shape and location of the slots 40 and 41 shown in FIG. 1. Similarly, the slider may have multiple weakened sections on each side thereof These multiple weakened side sections may be similar in shape and location of the slots shown in FIG. 2.

The sliders 10 and 60 may be formed from suitable polymeric materials such as, for example, nylon, polypropylene, polyethylene, polystyrene, Delrin or ABS. The sliders of the present invention may be formed by injection molding.

The sliders 10 and 60 may be made of different materials to enhance the functionality of each section thereof For example, section 72 may be made of a more flexible material than the remaining sections of the slider. One example of a slider has the section 72 made of a polyethylene elastomer, while the remaining sections 70 and 74 are made of a rigid polypropylene.

Figure 7:
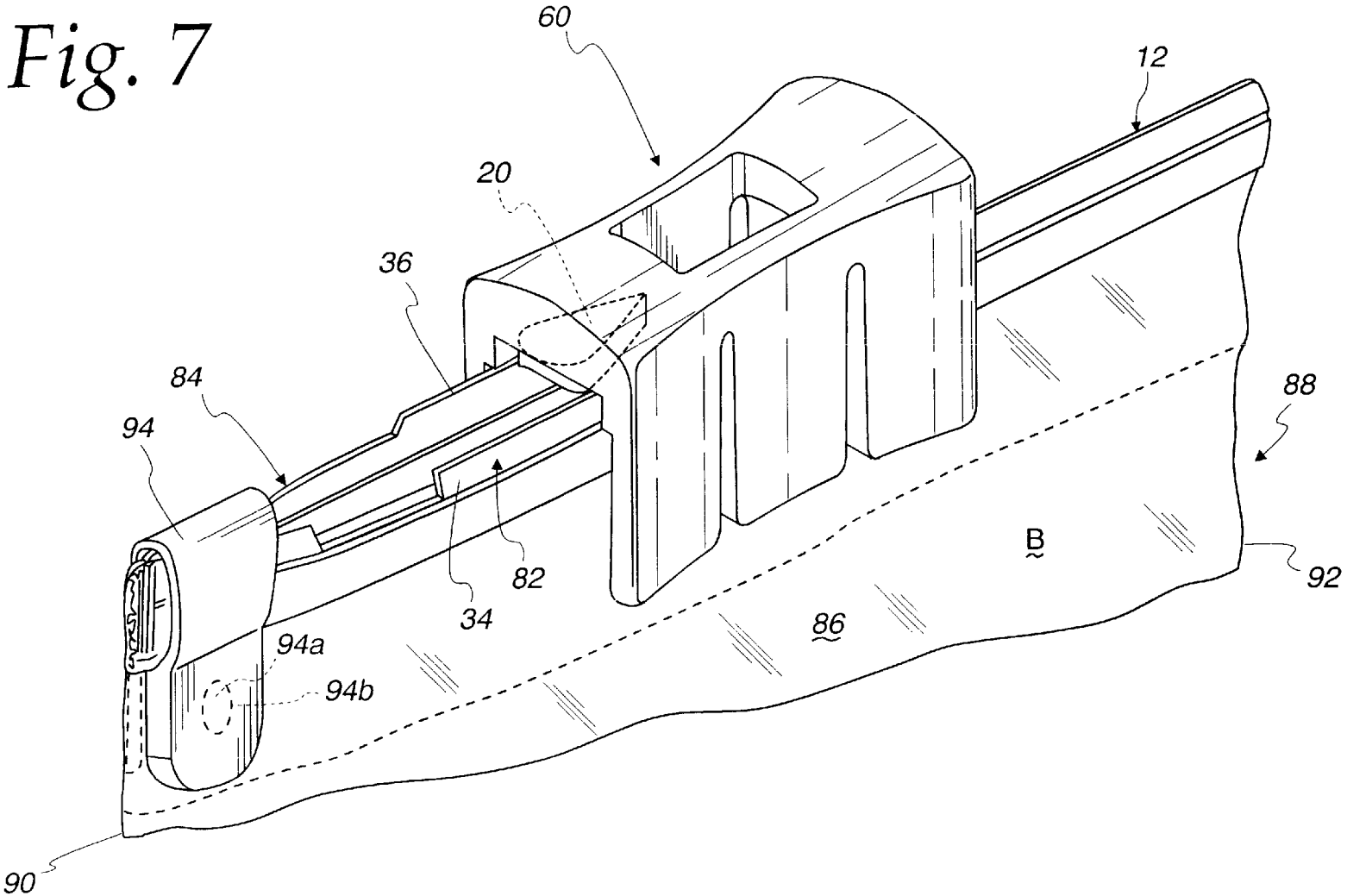
FIG. 7 is an enlarged perspective view of the fastener and slider of FIG. 2 in assembled position on a thermoplastic bag.

Referring to FIG. 7, the fastener 12 comprises a first track 82 and a second track 84. The first and second tracks 82 and 84 include respective first and second profiles 34 and 36. The first and second profiles 34 and 36 are interlocking and extend the length thereof in the form of rib and groove elements on the respective tracks. The tracks 82 and 84 may be extruded separately with a fin and attached to the respective sides of the bag mouth or the tracks 82 and 84 may be extruded integral with the sides of the bag mouth. If the tracks 82 and 84 are extruded separately, they are most effectively attached by means of a respective first and second fins, incorporated within the tracks, that is heat sealed to a bag mouth.

The fastener 12 typically comprises one or more polymeric resins. The fastener may be comprised of polyolefins including, but not limited to, polyethylene, polypropylene or combinations thereof.

The slider 60 and the fastener 12 are particularly suited for thermoplastic bags and the like. In one embodiment, the bag B is formed from a single flexible polymeric sheet folded upon itself and comprises first and second opposing body panels 86 and 88. Body panels 86 and 88 are fixedly connected to each other along a pair of sides 90 and 92 and a bottom (not shown) which extends between the pair of sides 90 and 92. In this embodiment, bag B has the fastener 12 extending along a mouth formed opposite the bottom (not shown) of bag B.

The body panels 86 and 88 typically comprise one or more polymeric resins. The body panels 86 and 88 may be comprised of polyolefins including, but not limited to, polyethylene, polypropylene or combinations thereof.

The opposite ends of the fastener 12 are typically provided with opposing end termination clips, such as end termination clip 94 of FIG. 7. End termination clips may have various purposes such as (a) preventing or inhibiting the slider for going past the ends of the fastener, (b) interacting with the slider to give a tactile indication of being closed, (c) assisting in inhibiting or preventing leakage from the bag and (d) holding the fastener together and providing additional strength in resisting stresses to the bag.

Each end clip 94 of FIG. 7 comprises a strap member that wraps over the top of the fastener 12. One end of the strap is provided with a rivet like member 94*a* that is adapted to penetrate through the bag material and into a cooperating opening 94*b* at the other end of the end clip 94. The rivet 94*a* is then deformed so as to create a head locked into the opening 94*b*.

It is contemplated that other end terminations may be used instead of the above-described end terminations clip 94. For example, an end weld may be formed by heated bars pressed against the end of the fastener, ultrasonic welding or other ways known in the art.

Figure 8A:
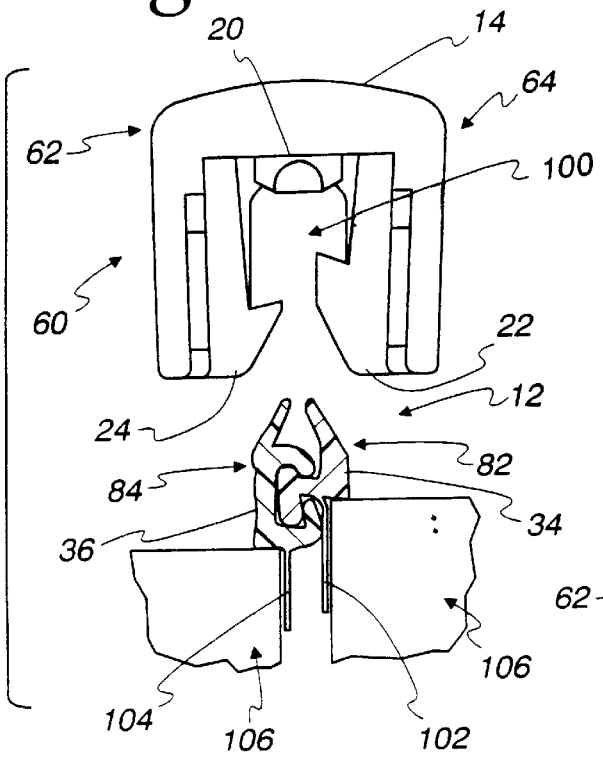
FIGS. 8*a–c* is a sequence of steps of inserting a fastener into a slider using a fastener supporting member according to one process of the present invention.
Figure 8B:
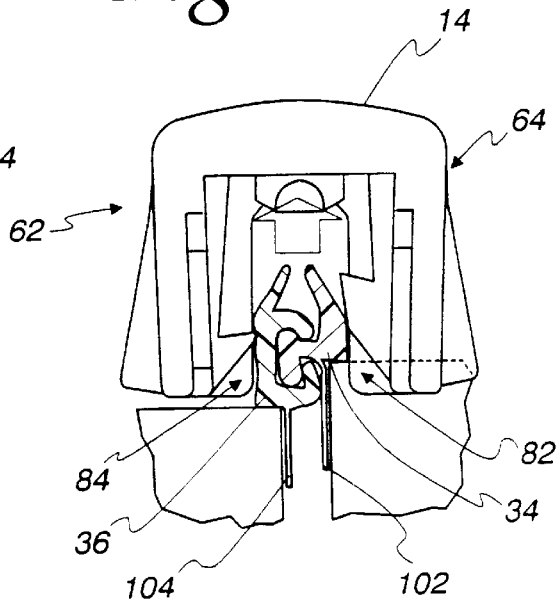
Figure 8C:
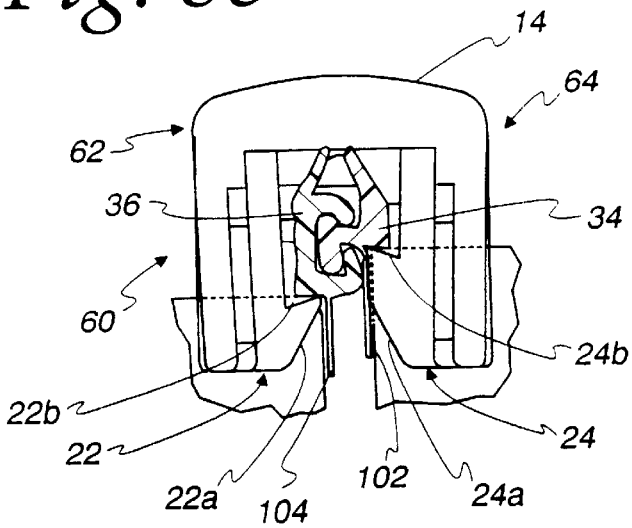

The slider 60 and the fastener 12 may be arranged by the sequence of steps shown in FIGS. 8*a*–8*c*. FIG. 8*a* depicts an end view of FIG. 2 taken from the end nearest the separator finger 20. The slider 60 of FIG. 8*a* includes a cavity 100 that is defined between the inner surfaces of the sides 62 and 64 and the top 14. FIG. 8*a* also depicts an end view of the fastener 12 with the first track 82 and the second track 84. The first track 82 includes the first profile 34 and a first fin 102 extending downwardly therefrom. The second track 84 includes the second profile 36 and a second fin 104 extending downwardly therefrom. The first and second profiles 34 and 36 are releasably engageable to each other. It is not necessary for the first and second tracks 82 and 84 to have fins depending therefrom.

The first and second profiles 34 and 36 of FIG. 8*a* are supported by a supporting tooling member 106. The supporting tooling member 106 of FIG. 8*a* assists in supporting the profiles 34 and 36 against the downward insertion force placed by the slider 60. The use of the supporting tooling member 106 allows the slider to be designed with greater sidewall strengths as compared to a slider that do not use support tooling. Such greater sidewall strengths assist in inhibiting or preventing side wall flexure and subsequent removal of the slider by the upward forces generated on the slider during the normal opening and closing of the fastener. The supporting tooling member 106 should be constructed so as to provide clearance as the slider 60 is being positioned onto the profiles 34 and 36. It is contemplated that a plurality of supporting tooling members may be used.

Referring to FIG. 8*b*, the sides 62 and 64 bend outwardly when the slider 60 is inserted onto the interlocking profiles of the fastener. More specifically, the section 72 of the sides 62 and 64 is bent outwardly in opposite directions away from each other to assist in positioning the slider 60 onto the engaged profiles 34 and 36 of the fastener 12. The section 72 of the sides 62 and 64 is bent sufficiently outwardly to allow insertion over the profiles 34 and 36. The section 72 should be rigid enough to inhibit or prevent inadvertent removal of the slider from the profiles 34 and 36, while not being so rigid as to prevent the slider 60 being placed onto the fastener 12. The thickness of the sides 62 and 64 of the section 72 may be optimized for flexibility in bending outwardly so as to receive the profiles of the fastener.

As shown in FIG. 8*c*, the profiles 34 and 36 of the slider 60 are installed into the cavity 100 of the slider 60. The slider 60 is shown in FIGS. 8*a*–*c* as being inserted generally perpendicularly to the fastener 12. The profiles 34 and 36 of the slider 60 are positioned over the respective shoulders 22 and 24. The tapered surfaces 22*a* and 24*a* are tapered upwardly and inwardly toward a centerline of the slider to assist in guiding the slider 60 onto the fastener. The shoulders 22 and 24 may also include upper tapered surfaces 22*b* and 24*b* to assist in inhibiting or preventing the slider from inadvertent removal from the fastener. The upper tapered surfaces 22*b* and 24*b* are tapered downwardly away from a centerline of the slider. The tapered surfaces 22*b* and 24*b* are generally tapered from about 2 to about 45 degrees and, more typically, from about from about 5 to about 15 degrees. The tapered surfaces 22*b* and 24*b* may also be referred to as undercuts.

The supporting tooling member 106 is also positioned such that it extends into the sides 62 and 64 via the slots of the slider. The supporting tooling member 106 is optimally sized and shaped to generally correspond with the slots of the sliders.

It is contemplated that other steps may be performed in placing the slider and fastener then are shown in FIGS. 8*a*–8*c*. For example, the slider may be placed onto the fastener by the methods disclosed in U.S. Pat. No. 5,007,143. Alternatively, the slider may be placed onto the fastener by opening up ears on the fastener slightly so as to allow the separator finger to be inserted therebetween. The slider may also be placed onto the fastener via a rotary or arc method.

Figure 9:
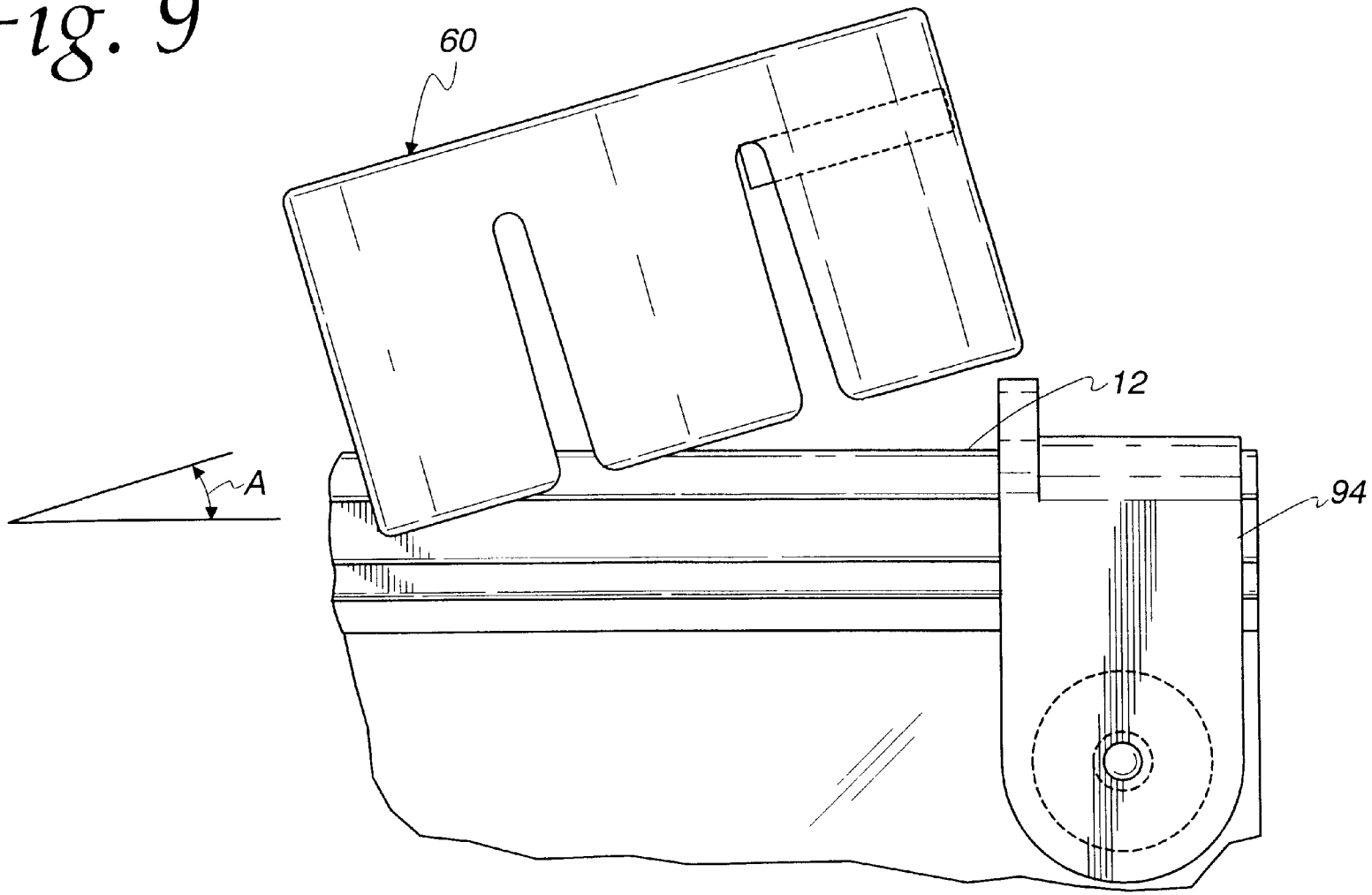
FIG. 9 is a slider being inserted onto a fastener according to one method.

Another method for inserting the slider is shown in FIG. 9 where the slider 60 is inserted at an angle A to the fastener 12. The angle A where the slider 60 is inserted onto the fastener 12 may vary from about 1 to about 90 degrees. The angle A is typically from about 15 to about 30 degrees. The slider may be inserted at the angle A via a linear or arc trajectory.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A slider for a reclosable fastener for plastic bags, comprising:

a body, the body including a top, a first side, a second side and a separation member on an underside of the top, the separation member adapted to open and close the fastener, the first side having at least one slot for separating the first side into at least two sections, the second side having at least one slot for separating the second side into at least two sections, each of the slots extending from respective ends of the first and second sides opposite the top and extending through the respective first and second sides.

2. The slider of claim 1, wherein the slider is unitary.

3. The slider of claim 1, wherein each of the slots extends in a generally vertical direction toward the top of the slider.

4. The slider of claim 3, wherein each slot of the first side corresponds with a respective slot of the second side.

5. The slider of claim 1, wherein the slider is formed by injection molding.

6. The slider of claim 1, wherein the first and second sides each have respective inner and outer surfaces, at least a portion of each of the inner surfaces forming respective shoulders, each of the shoulders having upper surfaces sloping upwardly toward a central region of the slider.

7. The slider of claim 1, wherein the first and second sides each have respective inner and outer surfaces, at least a portion of each of the inner surfaces forming respective shoulders, each of the shoulders having respective upper surfaces that generally correspond to bottom surfaces of a fastener profile.

8. The slider of claim 1, wherein the first and second sides each have respective inner and outer surfaces, each of the inner surfaces forming respective shoulders, each of the shoulders having respective lower surfaces that are adapted to assist in producing an outward bending of the sides.

9. The slider of claim 1, wherein the first side has at least two slots for separating the first side into at least three sections, and the second side has at least two slots for separating the second side into at least three sections.

10. The slider of claim 9, wherein the first side has a section that is more flexible than at least one of the remaining sections of the first side, and the second side has a section that is more flexible than at least one of the remaining sections of the second side.

11. A unitary slider for a reclosable fastener for plastic bags, comprising:

a unitary body, the body including a top, a first side, a second side and a separation member on an underside of the top, the separation member adapted to open and close the fastener, the first side having at least two slots for separating the first side into at least three sections, the second side having at least two slots for separating the second side into at least three sections, each of the slots extending from respective ends of the first and second sides opposite the top and extending through the respective sides, each of the slots on the first side corresponding to a respective slot of the second side.

12. The slider of claim 11, wherein each of the slots extend in a generally vertical direction toward the top of the slider.

13. The slider of claim 11, wherein the slider is formed by injection molding.

14. The slider of claim 11, wherein the first and second sides each have respective inner and outer surfaces, the inner surfaces forming respective shoulders, each of the shoulders having respective lower surfaces that are adapted to assist in producing an outward bending of the sides.

15. The slider of claim 11, wherein the first side has a section that is more flexible than at least one of the remaining sections of the first side, and the second side has a section that is more flexible than at least one of the remaining sections of the second side.

16. A slider for a reclosable fastener for plastic bags, comprising:

a body, the body including a top, a first side, a second side and a separation member on an underside of the top, the separation member adapted to open and close the fastener, the first side having at least two sections that are partially separated by at least one first weakened portion so as to assist in placing the slider onto the fastener, the second side having at least two sections that are partially separated by at least one second weakened portion so as to assist in placing the slider onto the fastener, the first and second weakened portions extending from respective ends of the first and second sides opposite the top and extending through the respective first and second sides.

17. The slider of claim 16, wherein the first and second weakened portions are perforations.

18. The slider of claim 16, wherein the body includes a first side having at least three sections that are partially separated from each other by first weakened portions and a second side having at least three sections that are partially separated from each other by second weakened portions.

19. The slider of claim 16, wherein the first and second weakened portions extend in a generally vertical direction toward the top of the slider.

20. A fastener and slider arrangement for plastic bags, comprising:

a fastener including first and second tracks that each have first and second ends, and first and second end terminations at respective first and second ends of the first and second tracks, the first and second tracks including respective first and second interlocking profiles, and a slider mounted on the first and second tracks, the slider including a top, a first side, a second side and a separation member on an underside of the top, the separation member adapted to open and close the fastener, the first side having at least one slot for separating the first side into at least two sections, the second side having at least one slot for separating the second side into at least two sections, each of the slots extending from respective ends of the first and second sides opposite the top and extending through the respective first and second side.

21. The fastener and slider arrangement of claim 20, wherein the slider is unitary.

22. The fastener and slider arrangement of claim 20, wherein each of the slots extends in a generally vertical direction toward the top of the slider.

23. The fastener and slider arrangement of claim 20, wherein the slider is formed by injection molding.

24. The fastener and slider arrangement of claim 20, wherein the first side has at least two slots for separating the first side into at least three sections, and the second side has at least two slots for separating the second side into at least three sections.

25. The fastener and slider arrangement of claim 24, wherein the first side has a section that is more flexible than at least one of the remaining sections of the first side, and the second side has a section that is more flexible than at least one of the remaining sections of the second side.

26. A fastener and slider arrangement for plastic bags, comprising:

a fastener including first and second tracks that each have first and second ends, and first and second end terminations at respective first and second ends of the first and second tracks, the first and second tracks including respective first and second interlocking profiles; and a slider mounted on the first and second tracks, the slider including a top, a first side, a second side and a separation member on an underside of the top, the separation member adapted to open and close the fastener, the first side having at least two sections that are partially separated by at least one first weakened portion so as to assist in placing the slider onto the fastener, the second side having at least two sections that are partially separated by at least one second weakened portion so as to assist in placing the slider onto the fastener, the first and second weakened portions extending from respective ends of the first and second sides opposite the top and extending through the respective first and second sides.

27. The fastener and slider arrangement of claim 26, wherein the first and second weakened portions are perforations.

28. The fastener and slider arrangement of claim 26, wherein the body includes a first side having at least three sections that are partially separated from each other by first weakened portions and a second side having at least three sections that are partially separated from each other by second weakened portions.

29. The fastener and slider arrangement of claim 26, wherein the first and second weakened portions extend in a generally vertical direction toward the top of the slider.

* * * * *